US012291886B1

(12) United States Patent
Hunt

(10) Patent No.: US 12,291,886 B1
(45) Date of Patent: May 6, 2025

(54) PORTABLE HOT ROOM SYSTEM AND METHOD OF USE

(71) Applicant: Brandon Hayden Hunt, North Richland Hills, TX (US)

(72) Inventor: Brandon Hayden Hunt, North Richland Hills, TX (US)

( * ) Notice: Subject to any disclaimer, the term of this patent is extended or adjusted under 35 U.S.C. 154(b) by 142 days.

(21) Appl. No.: 18/130,787

(22) Filed: Apr. 4, 2023

Related U.S. Application Data

(60) Provisional application No. 63/328,888, filed on Apr. 8, 2022.

(51) Int. Cl.
*E04H 1/12* (2006.01)

(52) U.S. Cl.
CPC ..... *E04H 1/12* (2013.01); *E04H 2001/1288* (2013.01)

(58) Field of Classification Search
CPC ..... E04H 1/12; E04H 2001/1288
USPC ..... 4/526, 524, 527, 534–535
See application file for complete search history.

(56) References Cited

U.S. PATENT DOCUMENTS 3,110,797 A * 11/1963 Vanne ..... A61H 33/063 126/400
3,271,786 A * 9/1966 Joy ..... A61H 33/06 607/81
3,351,956 A * 11/1967 Thoner ..... A61H 33/06 392/326
3,394,412 A * 7/1968 Olssen ..... A61H 33/06 D25/16
3,419,915 A * 1/1969 Clark, Jr. ..... F24H 3/0405 607/81
3,610,251 A * 10/1971 Sanderson ..... A61H 33/06 2/69.5
3,648,299 A * 3/1972 Durst ..... A61H 33/06 392/394
3,875,596 A * 4/1975 Noda ..... A61H 33/06 4/527
3,877,084 A * 4/1975 Johnson ..... A61H 33/06 4/526
3,945,058 A * 3/1976 Gardner ..... A61H 33/06 4/527
4,031,573 A * 6/1977 Romanoff ..... A61H 33/06 607/83
4,277,855 A * 7/1981 Poss ..... A61H 33/06 4/531
4,862,526 A * 9/1989 Berger ..... A61H 33/06 4/525
5,416,931 A * 5/1995 Wolfenden ..... A61H 33/06 607/81

(Continued)

FOREIGN PATENT DOCUMENTS

CA 2160403 A * 1/1997 ..... A61H 33/06
DE 20213147 U1 * 11/2002 ..... A61H 33/06

(Continued)

*Primary Examiner* — Lori L Baker
(74) *Attorney, Agent, or Firm* — Richard Eldredge; Leavitt Eldredge Law Firm

(57) ABSTRACT

A portable hot room system includes a plurality of panels creating an inner area; a plurality of adjustable supports configured to support the plurality of panels; a heat source disposed within the inner area; a humidity source disposed within the inner area; wherein the plurality of adjustable supports configured to hold the plurality of panels from a ground position to a ceiling position.

6 Claims, 15 Drawing Sheets

(56) References Cited

U.S. PATENT DOCUMENTS 5,441,529 A * 8/1995 Dorsch ..... A61H 9/00 607/82
5,511,254 A * 4/1996 O'Brien ..... A61H 33/06 4/526
5,546,678 A * 8/1996 Dhaemers ..... F26B 21/02 34/224
5,628,073 A * 5/1997 Popovich ..... A61N 5/06 392/416
5,950,254 A * 9/1999 Yasue ..... A61H 33/063 4/527
6,339,854 B1 * 1/2002 Amendt ..... A61H 33/06 607/83
6,510,565 B1 * 1/2003 Zwezdaryk ..... A61H 33/06 135/92
8,925,564 B2 * 1/2015 Zeldin ..... E04H 15/12 135/92
2002/0046422 A1 * 4/2002 Perett ..... E04H 1/125 4/524
2003/0024040 A1 * 2/2003 Akhtar ..... E04H 1/125 4/524
2003/0156831 A1 * 8/2003 Schaeffer ..... A61N 5/06 392/416
2004/0154093 A1 * 8/2004 Akhtar ..... A61H 33/06 4/526
2007/0277303 A1 * 12/2007 Lee ..... A61H 33/06 4/531
2008/0196152 A1 * 8/2008 Lozano ..... A61H 33/06 4/527
2009/0013459 A1 * 1/2009 Ma ..... A61H 33/066 4/524
2009/0019635 A1 * 1/2009 Chen ..... A61H 33/066 4/531
2010/0017953 A1 * 1/2010 O'Keeffe ..... G06Q 10/0639 219/480
2011/0113545 A1 * 5/2011 Driessen ..... B60R 9/06 4/476
2012/0240326 A1 * 9/2012 Guilbeau ..... A47K 3/00 4/597
2013/0042402 A1 * 2/2013 Parker ..... A61H 33/066 4/524
2013/0067656 A1 * 3/2013 Brunner ..... A61M 15/0036 4/597
2013/0098415 A1 * 4/2013 Zeldin ..... E04H 15/12 135/96
2014/0157511 A1 * 6/2014 Shurtleff ..... A61H 33/063 4/524
2016/0015597 A1 * 1/2016 Richards ..... H05B 3/008 392/416
2023/0097042 A1 * 3/2023 Zack ..... A61H 33/066 4/524

FOREIGN PATENT DOCUMENTS

GB 2373181 A * 9/2002 ..... A61H 33/06
WO WO-9324094 A1 * 12/1993 ..... A61H 33/06
WO WO-0215744 A2 * 2/2002 ..... E04H 1/125
WO WO-2005053596 A1 * 6/2005 ..... A61H 33/06

* cited by examiner

PORTABLE HOT ROOM SYSTEM AND METHOD OF USE

CROSS REFERENCE TO RELATED APPLICATIONS

This application is a continuation of the U.S. application Ser. No. 63/328,888 filed on Apr. 8, 2022, which is hereby incorporated by reference in its entirety.

BACKGROUND

1. Field of the Invention

The present invention relates generally to exercise systems and methods, and more specifically, to a portable hot room system that allows for a space to be isolated and then heated. When the space is heated exercises such as yoga are performed within to improve the performance of the exercise and the function of the person's body throughout the exercises.

2. Description of Related Art

Exercise systems are well known in the art and are effective provide for the use, strengthening, stretching, conditioning, and the like for the body of a person. Common exercise systems include yoga, where a person stretches different parts of their body to relieve stress, improve balance, and otherwise improve the body. In yoga, a person uses a mat or another surface that is gentle and comfortable for the body to rest on where they will put their body in positions designed to stretch muscles, ligaments, tendons, and the like. The position is commonly held for a time period and this holding action further improves the capacity of the person.

Hot yoga is similar to yoga but is performed in a hot and humid climate. The temperature is commonly raised to 105° F. and the humidity is raised by 40%. In this environment, the stretches are performed to the same ends but with greater exertion and effort due to the hot climate. This type of yoga commonly requires a room with the capabilities to create and sustain particular climate requirements.

One of the problems associated with common exercise systems is their limited use. For example, a space with particular climate requirements for hot yoga is rare and usually found in group settings such as gyms. Without the climate, yoga is not as effective this then limits the practitioners of hot yoga on where they can perform their exercises.

Accordingly, although great strides have been made in the area of exercise systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
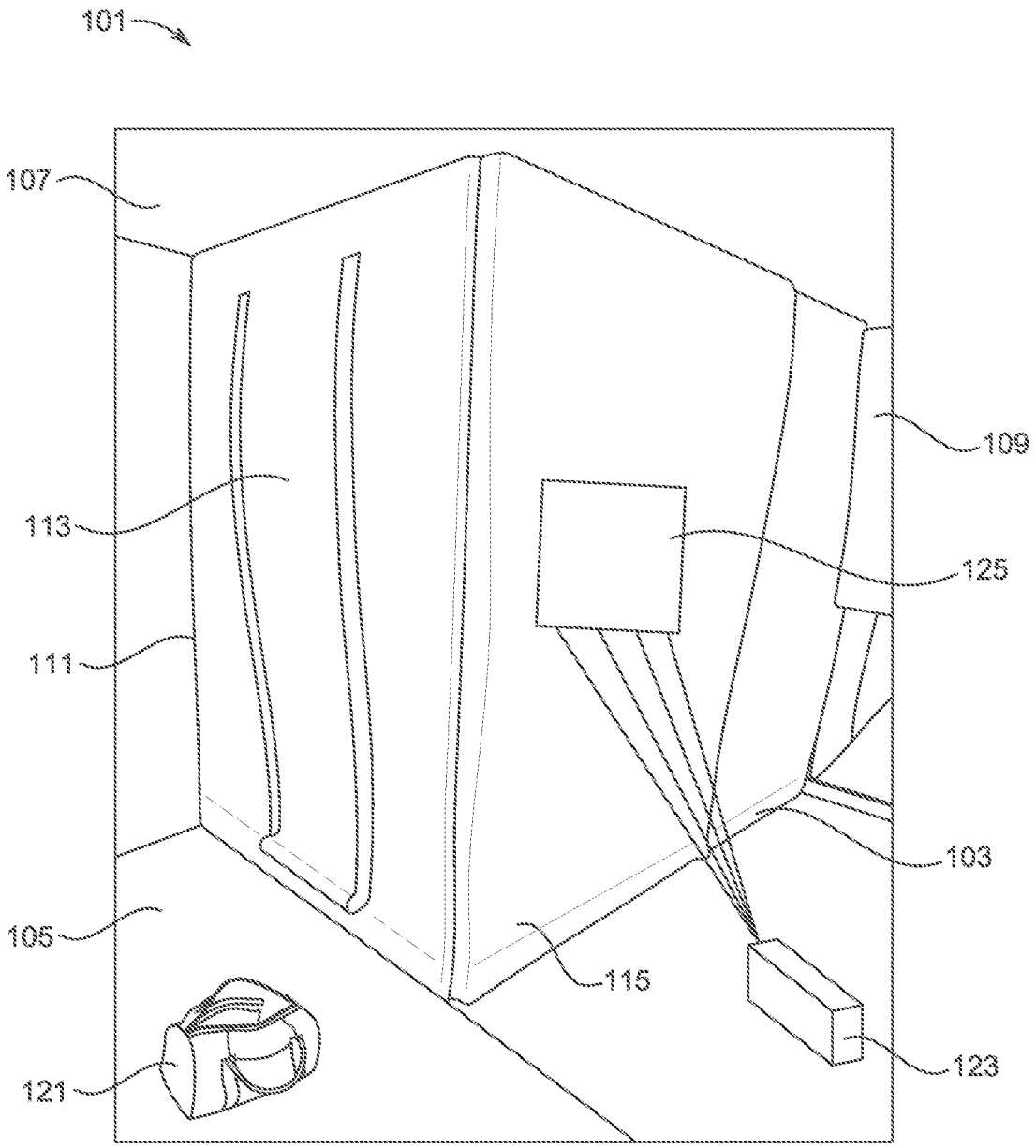
FIG. 1 is a front perspective view of a portable hot room system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional exercise systems. Specifically, the present invention enables the creation of a space where the temperate and humidity are controlled. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein reference characters identify corresponding or similar elements throughout the several views, FIGS. 1-15 depicts different views of a portable hot room system 101 in accordance with a preferred embodiment of the present application. It will be appreciated that portable hot room system 101 overcomes one or more of the above-listed problems commonly associated with conventional exercise systems.

In the contemplated embodiment, portable hot room system 101 includes a panel 103 that extends from a floor 105 to ceiling 107 between one or more room wall 109 where panel 103 creates a joint 111 where it meets said room wall 109 as shown in FIG. 1. System 101 further includes a plurality of adjustable supports 201, a plurality of compression blocks 301, a plurality of collars 131, a control guide with a snap hook 133, a plurality of grommets 135, and a plurality of clips 137.

Figure 2:
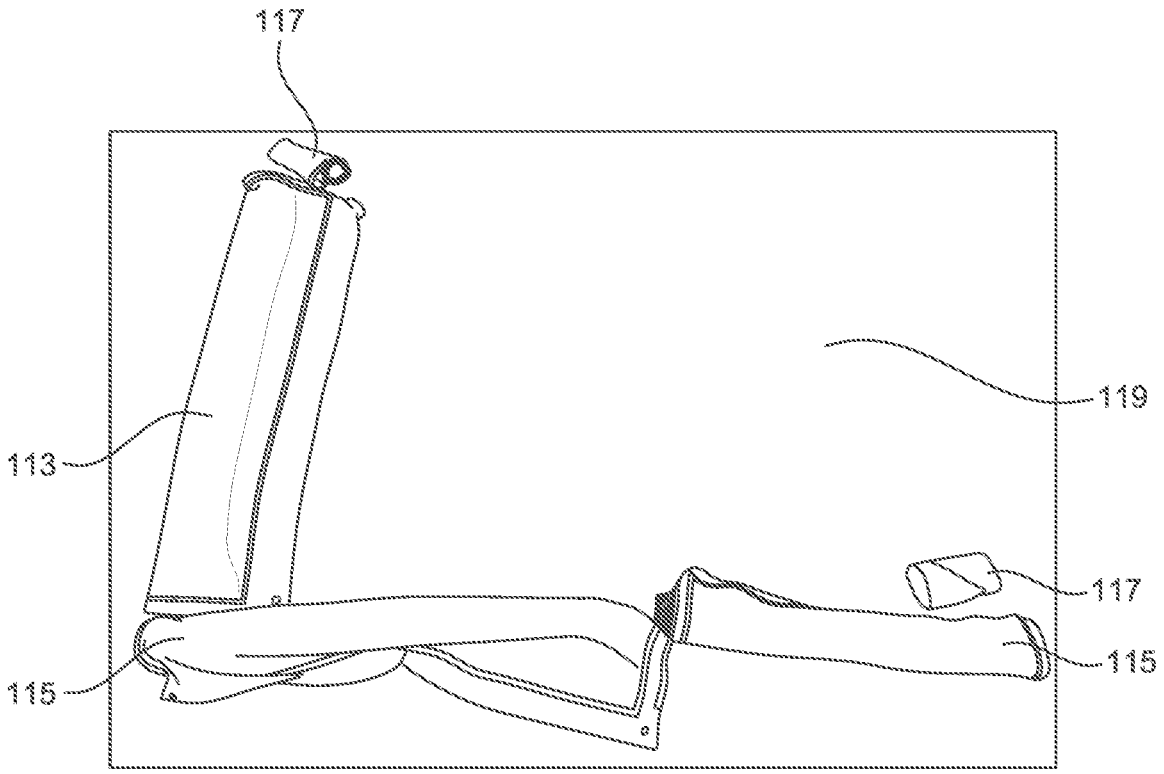
FIG. 2 is a laid-out view of panels of FIG. 1.
Figure 3:
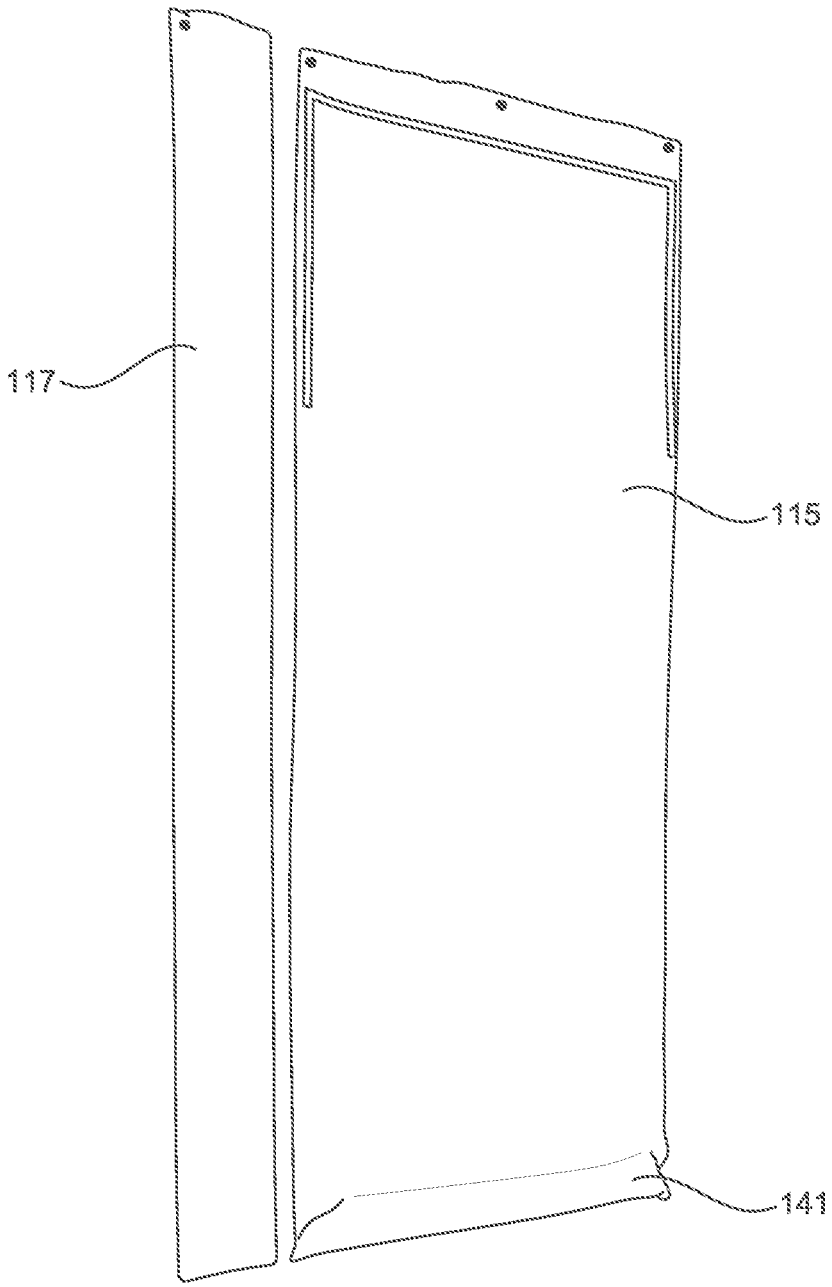
FIG. 3 is a laid-out view of a wall panel and corner panel of FIG. 1.

As shown in FIGS. 2-3, the panel 103 can be a single pre-configured unit of a portable hot room system including a door panel or may further comprise independent units of one or more door panels 113, a plurality of wall panels 115, and a plurality of corner panels 117 as required. The said door panel/s, corner panels, and wall panels are joined to each other to form panel 103, by a zipper 143, in different combinations and are interchangeable or modular depending on desired size or configuration, the panel 103 can be in one or more colors or a combination, preferably in white and black colors.

When the panel 103 is set up it isolates a space 119 therein. A projector 123 can be placed outside the space 119, to avoid overheating and projects an image 125 on the surface of the desired panel 103, preferably in white color which acts as a projection screen. The projector 123 can be capable of reverse projection, by projecting reversed image 125 of desired workout video onto a white colored panel 103 and facilitates the user of the portable hot room system 101 to follow the workout video and practice it inside the said system 101 as shown in FIG. 1.

When space 119 is formed a heat source and a humidity source are placed therein and activated to control the temperature and humidity thereof. It is contemplated that portable hot room system 101 is configured to be assembled when in use and disassembled when not in use and stowed in a portable storage bag 121.

In the preferred embodiment, panel 103 is made of ripstop nylon, which provides better insulation and is durable. White-colored ripstop nylon panel 103 allows image 125 to pass through so as to be visible from within space 119 to act as a projection screen.

Figure 7:
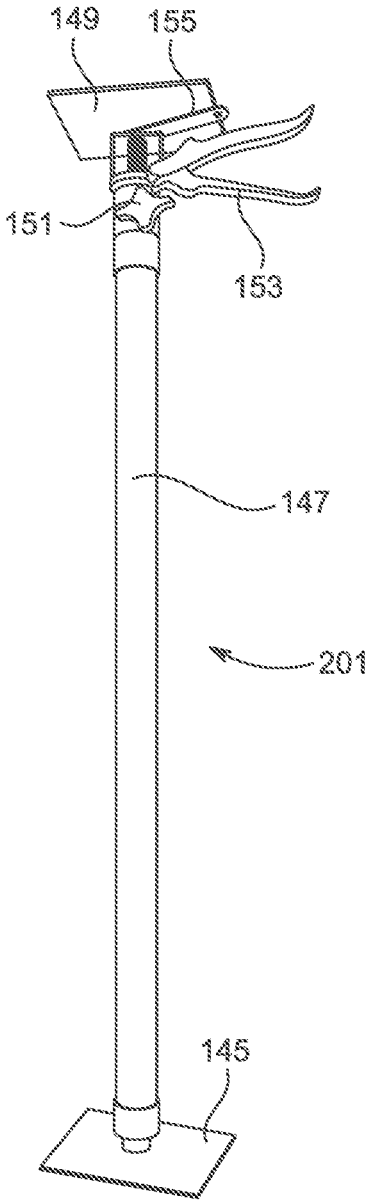
FIG. 7 is a front view of an adjustable support.
Figure 10:
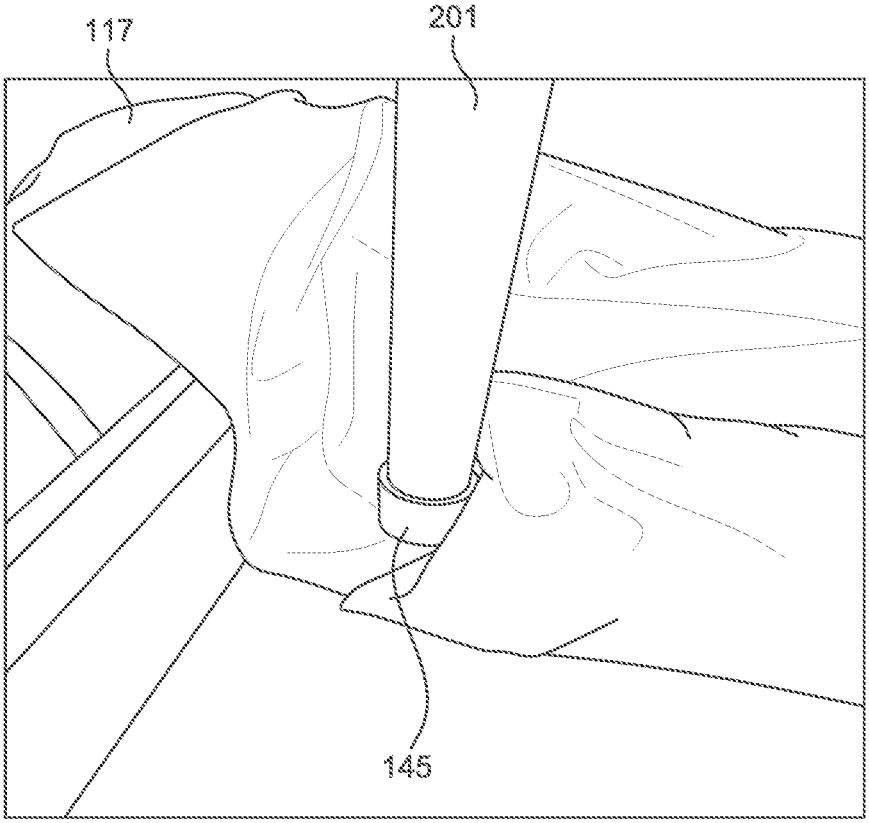
FIG. 10 is an adjustable support secured in the bottom sleeve of a corner panel.
Figure 11:
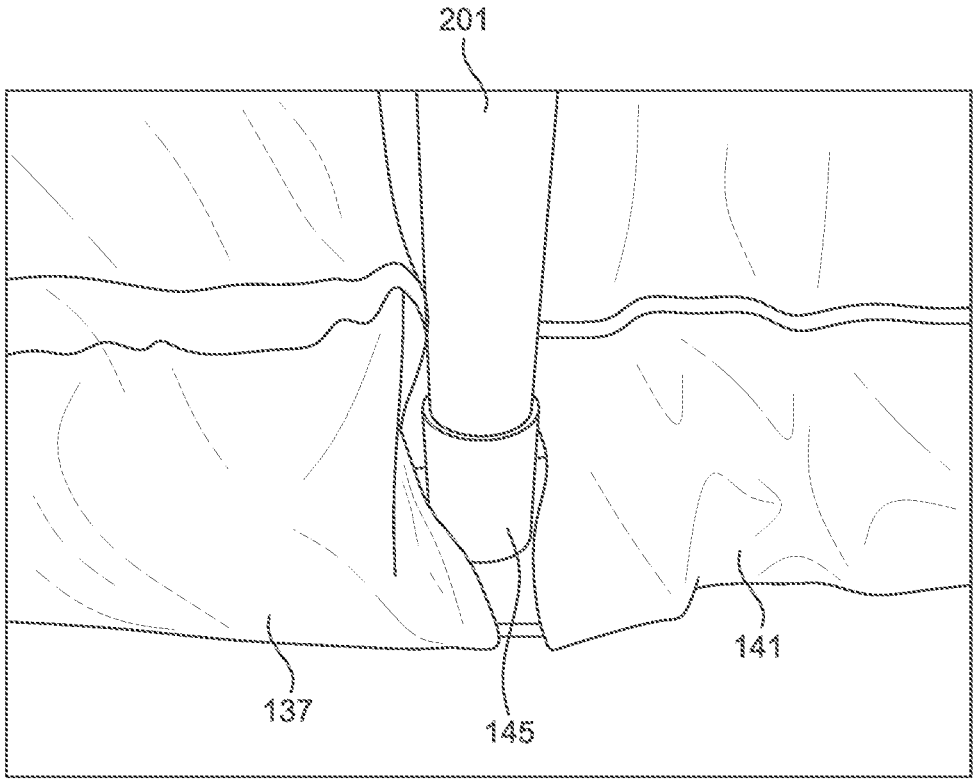
FIG. 11 is an adjustable support secured in the bottom sleeve of wall panels.

The adjustable supports 201 are configured to be operated in collapsed and extended configurations going up to 9.5 feet, and comprise a bottom portion 145, a middle portion 147, and a top portion 149. The adjustable supports 201 further comprise a knob 151 to extend the inner pole, a lever 153 used to extend the upper inner pole and a sliding tab 155 as shown in FIG. 7. The base of adjustable support 201 is inserted into the bottom sleeve 141 each of wall panel 115 and the bottom portion 145 of the said adjustable support is placed against the baseboard on the floor 105 and vertically parallel to the room wall 109 as shown in FIGS. 10-11.

Figure 4:
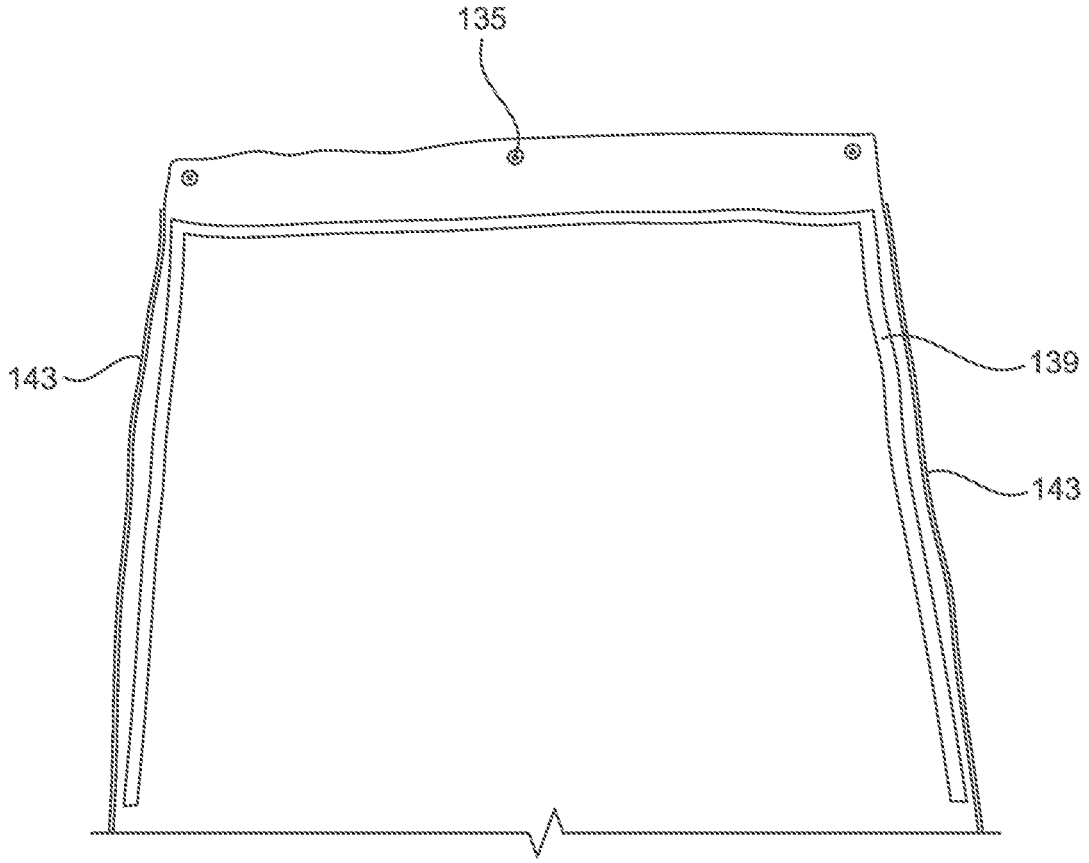
FIG. 4 is an interior view of the upper side of a wall panel of FIG. 1.
Figure 6:
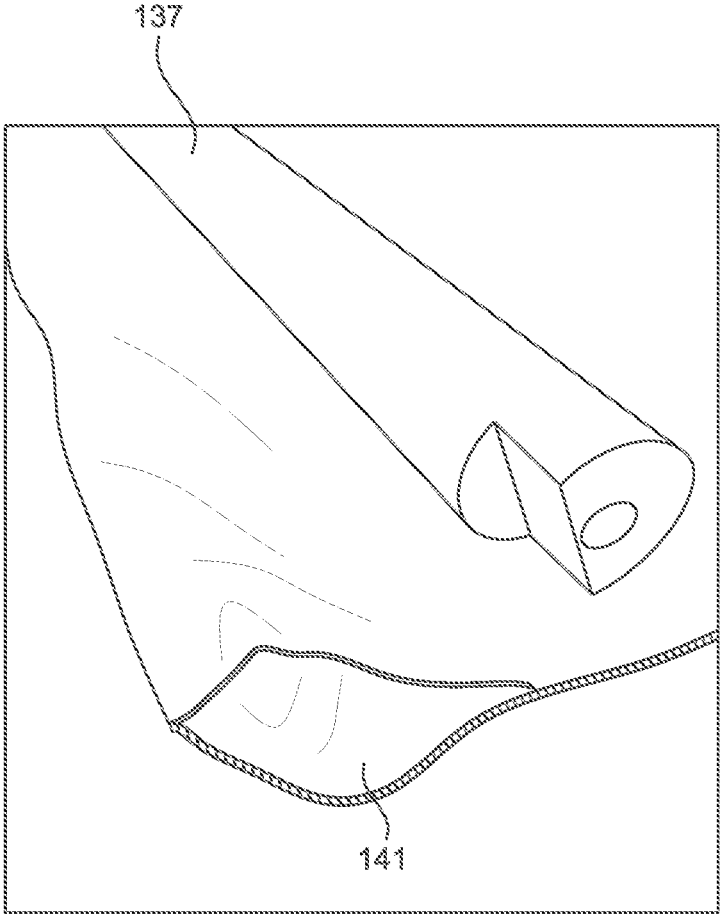
FIG. 6 is a bottom sleeve of a wall panel of FIG. 1 showing a modified foam cylinder.

The panel 103, preferably the door panel 113, and a plurality of wall panels 115, comprises a plurality of grommets 135 on the top portion and comprises a guide strip 139, made of thick fabric located on the interior upper side in vertical and horizontal positions and a bottom sleeve 141 configured to fit a modified foam cylinder 137 and a zipper 143 extending along the length on each side of the said panels as shown in FIG. 4 and FIG. 6. The vertical guide strip help guide the top of the adjustable support, and the horizontal guide strip help prevent the panel 103 from sliding off the adjustable support when erecting the portable hot room system 101 of the present invention.

Figure 13:
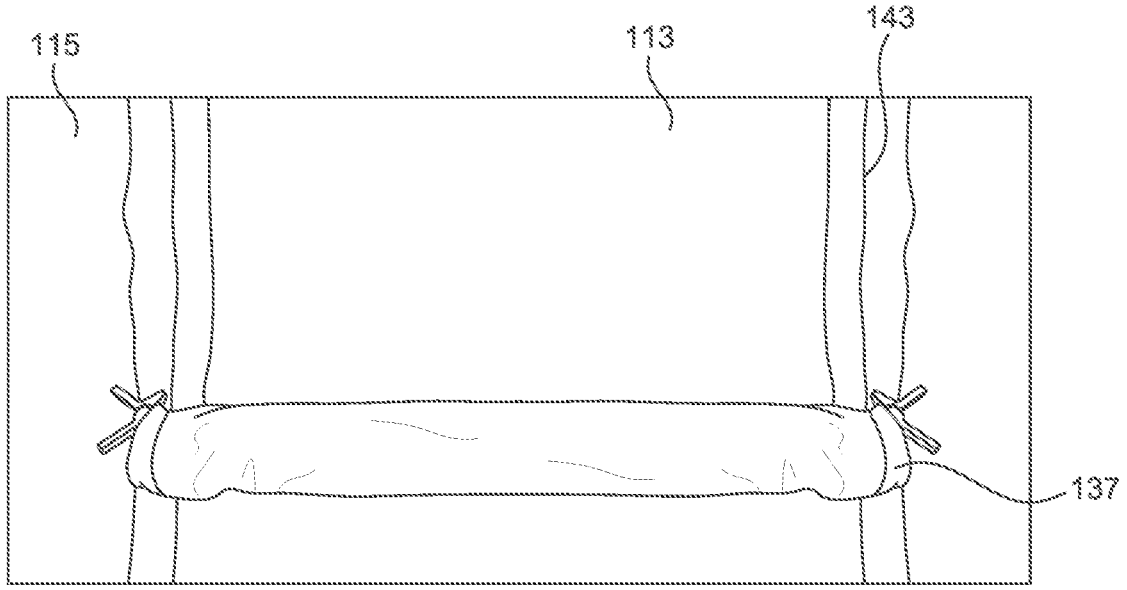
FIG. 13 is a door panel in a partially open configuration and secured with clips.

The door panel 113 facilitates entry and exit into the portable hot room system 101 and comprises a zipper 143 extending on each of the sides along the length of the door and further comprises a bottom sleeve configured to receive a foam cylinder 137, which when rolled down creates a light blocking seal by resting on the wall panel 115 base foam cylinder. The door panel 113 can be operated in open and closed configurations, with the zipper 143 fully fastened on both sides in the closed configuration. In the open configuration, the door panel can be, partially unzipped, rolled up, and securely held in the open configuration using clips 137 on both sides as shown in FIG. 13. The door panel can be configured to be an inbuilt feature of one of the wall panels 115 or can be an independent door panel as desired.

Figure 5:
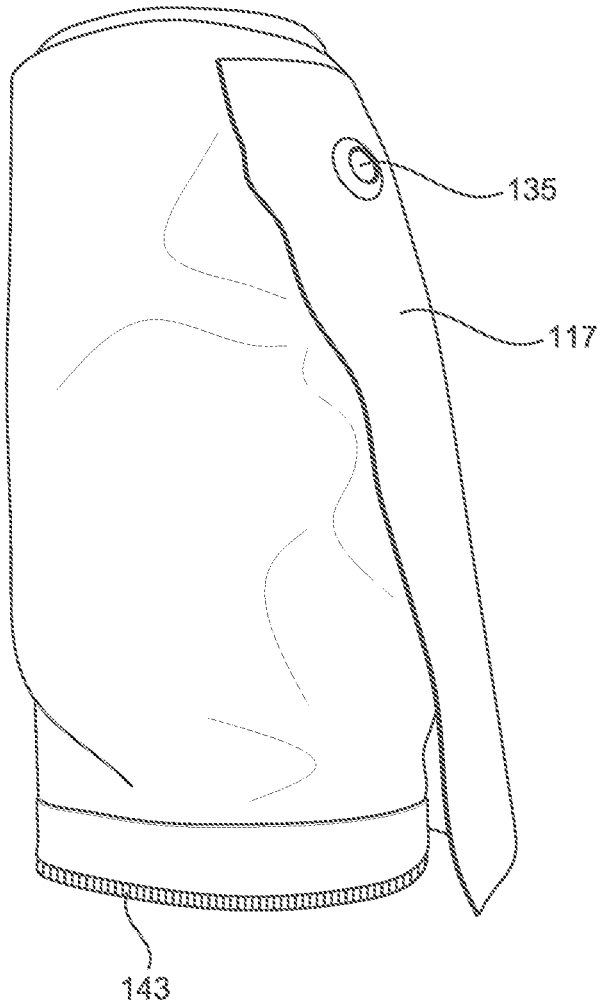
FIG. 5 is a rolled-up view of a corner panel of FIG. 1.

As shown in FIG. 5, the corner panels 117 of the present invention comprise one or more grommets 135 on the top portion and a zipper 143 extending along the length on one side of the said panel and rest on the room wall 109, when in use and are secured by compression blocks 301. The portable hot room system 101 of the present invention may comprise at least two of the corner panels. Each of the corner panels 117 can be erected using the sliding tab 155 located on the adjustable support 201 to secure the top corner using a compression block 301, which presses the corner panel against the room wall 109 creating a seal to block the light and trap the heat.

System 101 further uses compression block 301 to fit between adjustable support 201 and room wall 109 to firmly press the edge 205 against said room wall 109 to form a seal therebetween. Each of the corners uses four compression blocks 301 to make the portable hot room system 101, with a compression block 301 on top portion of the adjustable support 201 and against the room wall 109, one at the bottom portion of the adjustable support 201 and against the floor 105, and two compression blocks 301 at the middle portion of the said adjustable support. Each of the two compression blocks 301 located at the middle portion of the adjustable support 201 requires a collar 131 to rest on and are wrapped around the adjustable support 201.

Figure 9:
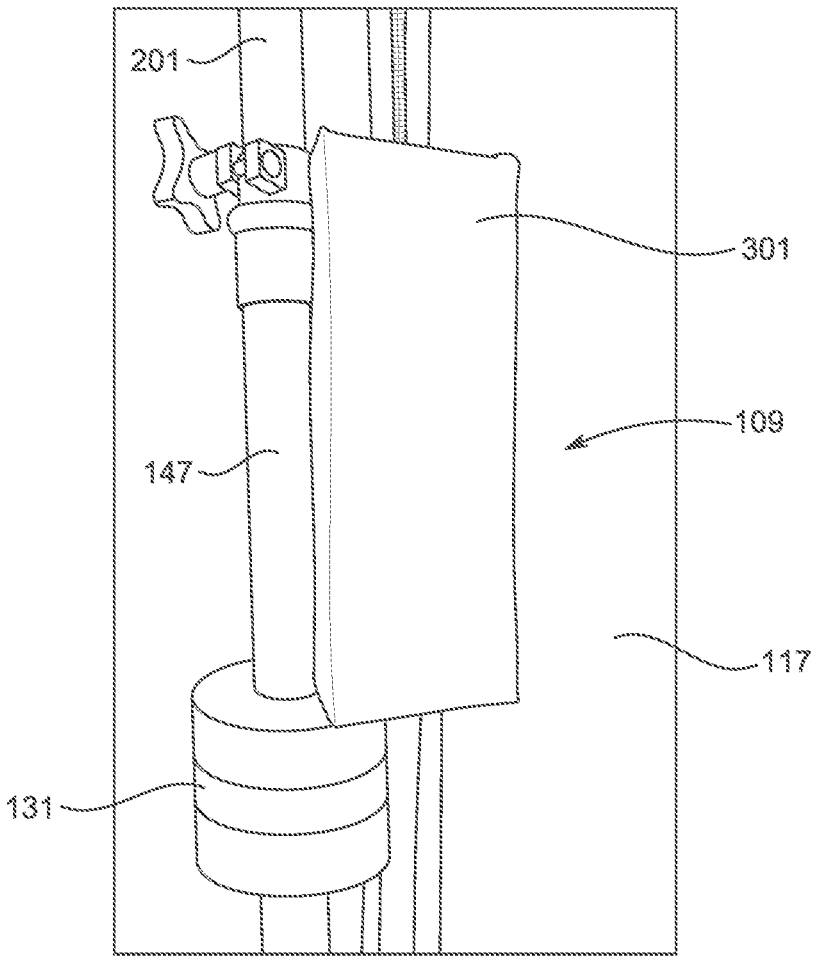
FIG. 9 is an internal view of a compression block and a collar in use.

Each of the collar 131 wrap around adjustable supports 201 and is secured in place using a Velcro strap, with a compression block 301 resting on the collar 131 and placed against the adjustable support 201 and the room wall 109, inside the space 119. Each of the collar 131 provides support to hold the compression block in place and prevent it from sliding down to the bottom of the adjustable support 201 as shown in FIG. 9.

The grommets 135 of the present invention can be metal grommets. Clips 137 facilitate securing both sides of the rolled-up door panel 113 in an open configuration and are also used to straighten and de-wrinkle the panel 103 when being used as a projection screen and for clipping the white wall panel to the adjustable support 201 at multiple locations.

Figure 8:
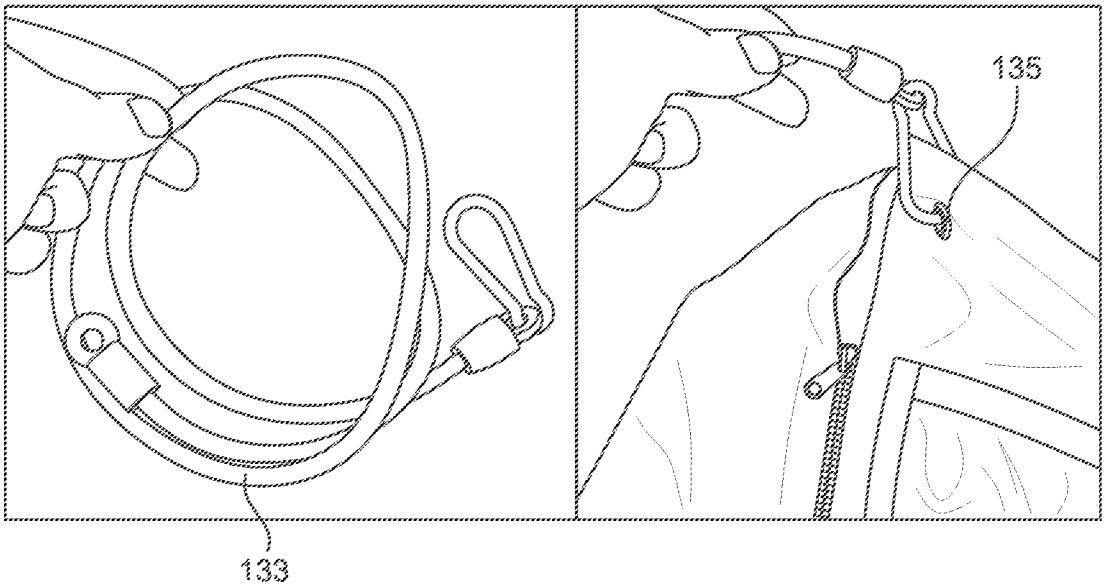
FIG. 8 is a control guide with a snap hook connected to a grommet.

The control guide with snap hook 133 facilitates controlling the erection of panel 103 from the floor 105. The snap hook of the control guide is connected to panel 103 by hooking into the grommet 135 located on top of the panel 103 as shown in FIG. 8. The base of adjustable support 201 is inserted and secured into bottom ends of panel sleeves. Using the control cord with one hand and following the guide strips to control the panel 103 from slipping off adjustable support 201, the panel 103 can be erected, and simultaneously using the other hand to extend the adjustable support 201 until the top of said adjustable support secures the upper part of the panel 103 to the ceiling 107.

Figure 12:
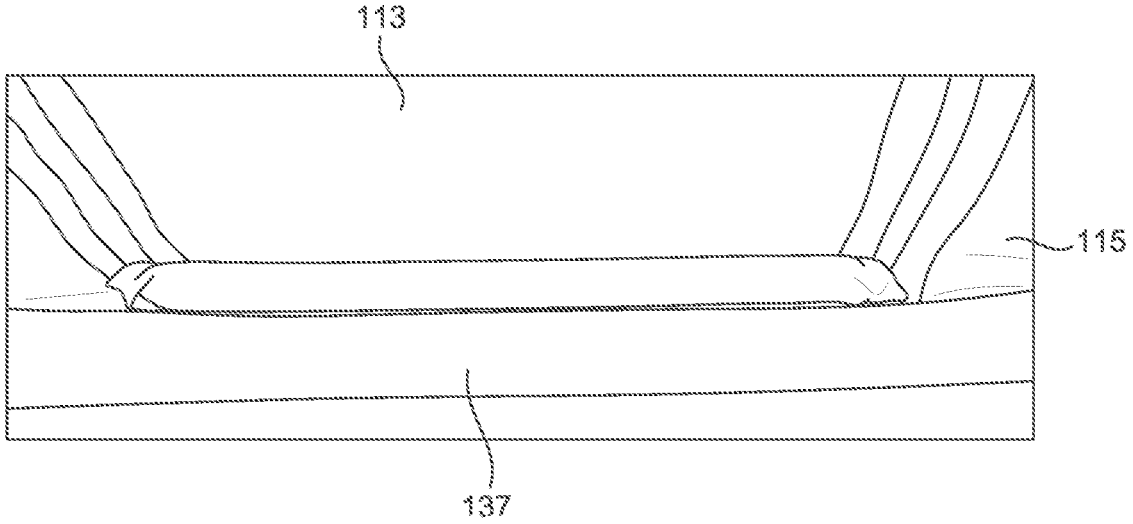
FIG. 12 is a door panel in a fully closed configuration.

Panel 103 is erected by adjustable supports 201 that hold the top edge of panel 103 against ceiling 107 and the bottom edge against floor 105. When panel 103 meets room wall 109 or must be joined to another panel, the side edges are zippered together so that a resealable joint attached thereto creates a seal therebetween. The base of panel 103 is configured to fit a modified foam cylinder 137 into a bottom sleeve, the weight of the foam cylinder 137 allows the resting of the wall panel stably on floor 105 and allows the support poles 201 to rest underneath the said foam cylinder. The foam cylinder 137 further allows easy roll-up and storage of the panel when not in use. Extra flaps of fabric on each side of the said foam cylinder sleeve help to create a light-blocking seal when the door panel 113 is closed as shown in FIG. 12.

When panel 103 is closed against room wall 109 it is contemplated that the wall surface may not be smooth and that these non-smooth areas could prevent or complicate the creation of a high temperature and humidity in space 119, the compression block 301 helps in smoothing out panels 103 to fit between adjustable support 201 and room wall 109 to firmly press the edge against said room wall 109 to form a seal therebetween and creates a hot room with evenly distributed heat and humidity.

Figure 14:
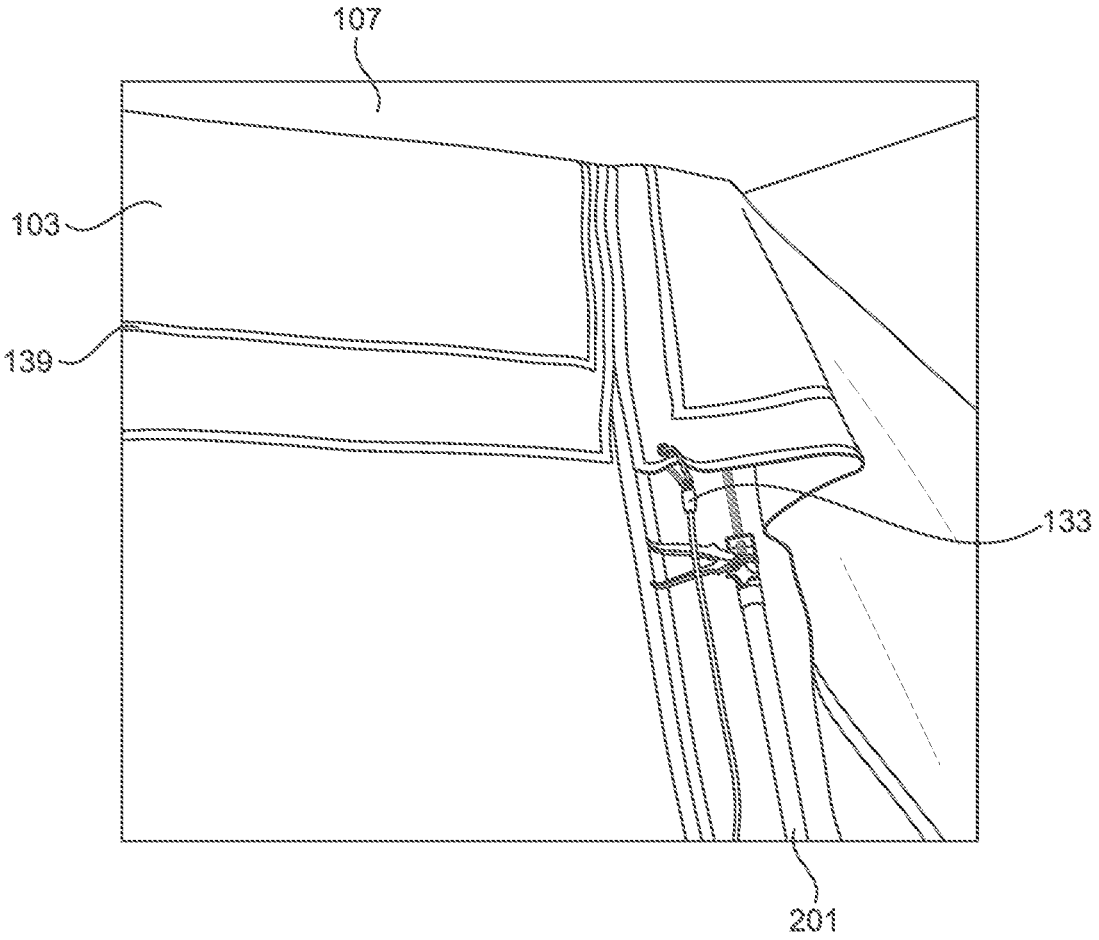
FIG. 14 is the erection of wall panels using adjustable support and guide strips.

In use, an existing room is selected and panels 103 are laid out to delineate space 119. Adjustable supports 201 are extended to touch the ceiling 107, the top edge of panels 103 is placed between adjustable supports 201 and ceiling 107 and adjustable supports 201 are tightened to hold panels 103 against ceiling 107 following the guide strips 139 as shown in FIG. 14. Where panels 103 meet room walls 109 the side edges are joined to room walls 109 and as needed compression blocks 301 are wedged between adjustable supports 201 and room wall 109 to ensure a seal therebetween. A person enters space 119 and activates a heat source and a humidity source to create a hot room where they can exercise or the like.

It should be appreciated that one of the unique features believed characteristic of the present application is that a heat and humidity-controlled space can be erected in most locations by panel 103 and adjustable supports 201. The space could be used for hot yoga or any other purpose that requires the control of temperature and humidity. The present invention facilitates the erection of a portable hot room system anywhere, easily, without the need for a ladder or step stool. Easy control of panel 103 from the floor is facilitated by the control guide with snap hook, grommets, and guide strips when erecting the portable hot room system, and no tape or adhesive is used or needed to erect and use the portable hot room system 101. The portable hot room system of the present invention can be used for exercise, yoga, healing therapies, massages, steam therapy, pain treatment and rehabilitation, and other beauty therapies. The portable hot room system is compact, lightweight, easy to assemble and disassemble with minimal training, well insulated, energy-efficient, and can be customized in size as per size and need.

Figure 15:
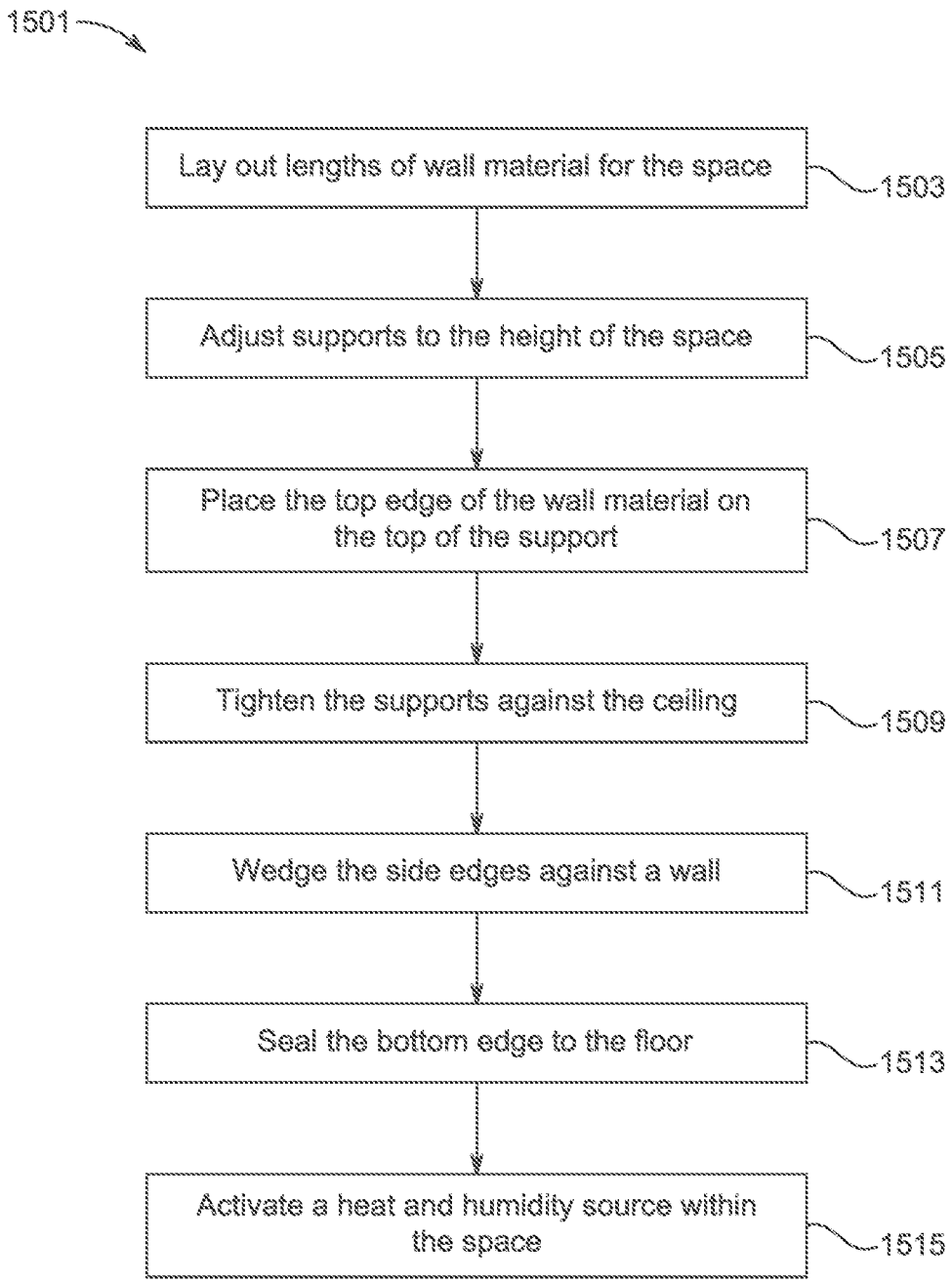
FIG. 15 is a method of creation of a portable hot room system according to the present invention.

Referring now to FIG. 15 a method of creating a hot room, using portable hot room system 101 is depicted. Method 1501 includes laying out lengths of wall material for space 1503, adjusting the supports to hold the height of the space 1505, placing the top edge of the wall material on the top of the supports 1507, tightening the supports against the ceiling 1509, wedging the side edges against a wall 1511, sealing the bottom edge to the floor 1513, and activating a heat and humidity source 1515.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A portable hot room system comprising:

at least one panel creating an inner area and composed of ripstop nylon fabric with a panel being white for projection and a remaining panels being gray for structure; and a plurality of adjustable supports configured to support the plurality of panels;

wherein the plurality of adjustable supports are adjustable and are configured to hold the plurality of panels from a ground position to a ceiling position.

2. The system of claim 1, further comprising a door extending through one of the plurality of panels.

3. The system of claim 1 wherein the plurality of panels are composed of a polyethylene vinyl acetate material.

4. A method, comprising:

laying out modular, zipper-connected wall panels composed of a white ripstop nylon to create a projection screen and gray ripstop nylon for a wall and a zipper door;

extending a plurality of adjustable supports to secure a height of a space;

placing a top edge of a wall material on the top of the plurality of adjustable supports;

erecting and securing the zipper-connected wall panels using a control guide with a snap hook, allowing the user to install the zipper-connected wall panels from a ground surface without the need for a ladder;

tightening the plurality of adjustable supports against a ceiling;

wedging foam blocks upholstered in ripstop nylon against a wall to create a thermal seal, preventing heat and humidity from escaping;

sealing the bottom edge of the structure to the floor;

integrating a zipper door within one of the gray ripstop nylon panels, consisting of two vertically spaced nine-foot zippers running from top to bottom to allow controlled entry and exit;

utilizing a white ripstop nylon panel that doubles as a rear projection screen, serving as an integral part of the structure;

positioning a projector outside the enclosed space and aligning it with the white ripstop nylon panel for rear projection, allowing for high-quality display while keeping sensitive electronics outside the high-heat, high-humidity environment;

connecting a PC, wireless mouse, microphone, and camera to enable live virtual instruction including ZOOM classes, for an immersive class experiences within the enclosed space;

activating the heat source and humidity source within the confined space to create the desired environmental conditions for hot yoga or other fitness practices.

5. A method, comprising:

providing the system of claim 1;

tightening the adjustable support poles to secure the ripstop nylon panels to the ceiling and floor;

activating the heat source within the confined area.

6. The method of claim 5, further comprising:

adjusting the humidity levels within the confined area using the humidity source to achieve desired environmental conditions.

* * * * *